US008794459B2

(12) United States Patent
Dover et al.

(10) Patent No.: US 8,794,459 B2
(45) Date of Patent: Aug. 5, 2014

(54) FLUID CONTAINER

(75) Inventors: Suzanne Mary Dover, Bumham (GB); Peter Booth, Marlborough (GB); Corinne Elstow, Marlborough (GB); William Maskell, Marlborough (GB); Alan Whiting, Marlborough (GB)

(73) Assignee: Nestec S.A., Vevey (CH)

( * ) Notice: Subject to any disclaimer, the term of this patent is extended or adjusted under 35 U.S.C. 154(b) by 709 days.

(21) Appl. No.: 12/865,149

(22) PCT Filed: Feb. 3, 2009

(86) PCT No.: PCT/EP2009/000696

§ 371 (c)(1),
(2), (4) Date: Oct. 27, 2010

(87) PCT Pub. No.: WO2009/098023

PCT Pub. Date: Aug. 13, 2009

(65) Prior Publication Data

US 2011/0031206 A1 Feb. 10, 2011

(30) Foreign Application Priority Data

Feb. 4, 2008 (GB) ..... 0802031.5

(51) Int. Cl.
*B65D 1/02* (2006.01)
*B65D 1/40* (2006.01)

(52) U.S. Cl.
USPC ..... 215/40; 215/381; 215/900; 215/379; 215/11.1; 222/527

(58) Field of Classification Search
USPC ..... 215/900, 40, 43, 381, 11.1; 222/527, 222/529, 530
See application file for complete search history.

(56) References Cited

U.S. PATENT DOCUMENTS

| | | | | |
|---|---|---|---|---|
| 3,323,694 | A * | 6/1967 | Stevens, Jr. | 222/498 |
| 4,492,324 | A * | 1/1985 | Weber | 222/529 |
| 4,572,412 | A * | 2/1986 | Brach et al. | 222/527 |
| 5,044,509 | A | 9/1991 | Petrosky et al. | |
| 5,464,107 | A | 11/1995 | Koeniger | |
| 6,793,094 | B2 * | 9/2004 | Turnbough | 220/603 |
| 6,988,629 | B2 * | 1/2006 | Pedmo et al. | 215/365 |
| 2008/0264892 | A1 | 10/2008 | Nozawa | |

FOREIGN PATENT DOCUMENTS

| | | | |
|---|---|---|---|
| EP | 1241102 | A | 9/2002 |
| WO | WO03/059753 | A | 7/2003 |
| WO | WO2005/086918 | A | 9/2005 |

* cited by examiner

*Primary Examiner* — Tri Mai
(74) *Attorney, Agent, or Firm* — K&L Gates LLP

(57) ABSTRACT

A fluid container (10) comprises a body (12), a neck (16), and a mouth (14) The neck is deformable from a first stable condition to a second stable condition, allowing the relative angle of the mouth to be changed.

7 Claims, 4 Drawing Sheets

FLUID CONTAINER

The present application represents the national stage (35 USC 371) of International Application PCT/EP2009/000696 filed on Feb. 3, 2009, which claims the benefit of Great Britain Patent Application No. 0802031.5, filed on Feb. 4, 2008.

This invention relates to a fluid container with a deformable neck allowing the angle of the mouth of the container to be varied between two stable conditions, and is particularly concerned with feeding bottles for babies.

It is known to provide a bottle with means to angle the opening by attaching a flexible spout to the mouth of the bottle. This can aid pouring of the contents and also provide an improved angle for feeding babies. However, having a separate attachment is inconvenient and a potential contamination hazard. It is further known to make a pourer flexible, for example with a concertina-type structure, so that an extra attachment is not needed. However, the flexible part is intended to be freely movable and generally requires both hands in use. A flexible pourer can be inconvenient for filling, and also for storage and transportation where it is advantageous that containers have a compact shape, so that they pack efficiently. In addition, flexible pourers and spouts tend to be unstable, and this may create problems if the flexible part moves during transport or in use.

According to the present invention there is provided a fluid container comprising a body having a neck and a mouth, said container being deformable from a first stable condition to a second stable condition, thereby to change the relative angle of said mouth. In a preferred embodiment the container is deformable at the neck. In this specification the terms 'neck' defines a region immediately adjacent the mouth of the container. Preferably the container is reversibly deformable so as to permit return to the previous condition, if required.

Preferably said neck defines in said first condition, a channel at one side, said channel being closed by approaching sidewalls thereof in said second condition. The channel is preferably arranged to ensure movement of said neck in a desired direction.

In the preferred embodiment the mouth can in use adopt one of two end positions. In the first condition, the mouth of the container is in the conventional, generally upright, position, so the container can be filled easily; the container may be more suitable for transportation and storage as the container can have a more compact shape and so pack more efficiently. In this condition the neck and container have a common axis of rotation. As the first condition is stable no means to secure the neck is needed to ensure the container maintains the compact shape. In the second position the mouth can be arranged at an angle to facilitate pouring or feeding; in this condition the axis of the mouth and container are not aligned. In the case of feeding a baby, the angle allows the feeder to adopt a more comfortable arm position. In addition, the fact that the mouth can be secured at an angle facilitates one-handed pouring or feeding. In the case of feeding babies, the second hand is available to support the baby.

Furthermore if the axis of the container is up with respect to the axis of the neck, the neck remains flooded until a greater percentage of the contents have been dispensed. Such an arrangement is of great benefit in feeding since it can avoid the sucking in of air which may be particularly uncomfortable to a baby. The change of container volume on movement from the first to the second condition is small, preferably less than 5%.

Preferably said channel is V-shaped between an upper edge and a lower edge, preferably a non-regular V-shape so that the V comprises a long sidewall edge and a short sidewall edge.

The channel is typically transverse to the upright axis of the container. Preferably the long sidewall and short sidewall meet in the bottom of the channel at an angle of between 50° and 90°, and more preferably at an angle of between 65° and 85°.

Preferably the short sidewall is nearer the mouth of the bottle.

In a preferred embodiment the ratio of the width of the long sidewall to the short sidewall at the point of greatest depth is between 1.25 and 1.75, and more preferably between 1.40 and 1.60.

The channel may extend around substantially more than half of the perimeter of said neck, preferably around substantially the whole of the perimeter of said neck. A channel which extends around the neck can be wide and thus may be better adapted to allow the sidewalls to approach. A wider channel allows a larger deflection angle to be obtained, and hence a greater degree of deformation.

Preferably the width and depth of the channel increase to maximum values at a point at the centre of the length of the channel, and preferably the upper edge of the channel is at an oblique angle to the mouth. The channel is preferably symmetrical about an upright plane or upright axis of the container.

The upper edge of the channel is preferably planar, and the lower edge is also preferably planar.

More than one channel may be provided. This provides the possibility of one or more intermediate stable conditions, or for a large angular deformation without excessive depth of channel.

The container is typically a mouldable resilient plastic, such as PET or polyethylene, and of a kind inherently adapted to retain shape in normal use so as, for example, to stand upright whether full or empty.

In a preferred embodiment, the mouth of the container is closed by a film. The film preferably provides a hermetic seal, and may for example be a plastics/foil composite welded over the mouth and having a pull tab for removal thereof.

Such a seal, if attached with the neck in the first condition, allows the container to better resist vertical loads which may be imposed during stacking. Such loads tend to reduce the volume of the container, and are resisted as the contents come under pressure. In use removal of the seal eliminates such resistance, and deformation of the neck is possible. The seal also prevents movement to and from the second condition prior to dispensing of the contents, which may avoid fatigue of the container wall. A tight fitting closure, such as a screw cap, can provide the same benefit.

The container is preferably a multi-layer plastic moulding having suitable oxygen and light barriers to avoid degradation of the contents. Other layers may provide colour and a taint barrier. In a preferred embodiment, the container may include a clear wall portion to allow the level of the contents to be determined. Such a panel may for example comprise a clear strip extending from the base to the neck, and 2-3 mm in width. A level gauge of this kind is useful in avoiding over-feeding of a baby.

In the alternative a clear container may have a sleeve placed thereon to provide an ultra-violet barrier. Such a sleeve may be readily printed with information about the container contents, and may include a clear wall portion to provide a level indicator. The sleeve may be over the deformable region of the container only.

In one preferred embodiment such a sleeve is shrink wrapped onto the container, and may also extend up and over the container closure to provide a tamper indicator. A suitable line of weakening allows the tamper indicator portion to be removed, thus allowing the container to be opened. Such a sleeve may also enhance stiffness of a container according to the invention, so as to better resist vertical loads during transit and storage. Removal of the sleeve or a portion thereof facilitates deformation from the first to the second condition in use.

A fluid container in accordance with the invention will now be described by way of example with reference to the accompanying drawings which:

Figure 1:
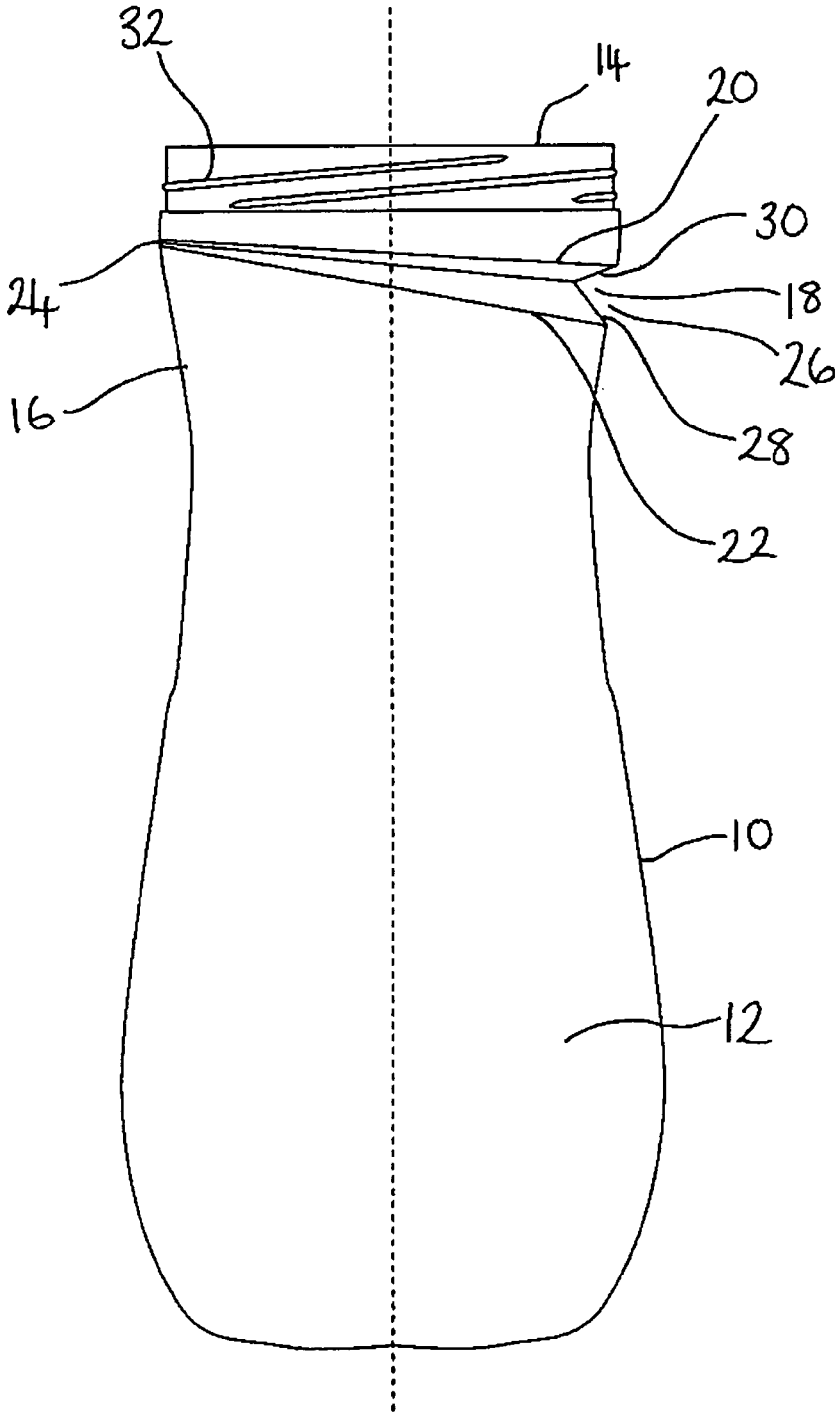
FIG. 1 is a view of a bottle from the side with the neck in the first condition.
Figure 2:
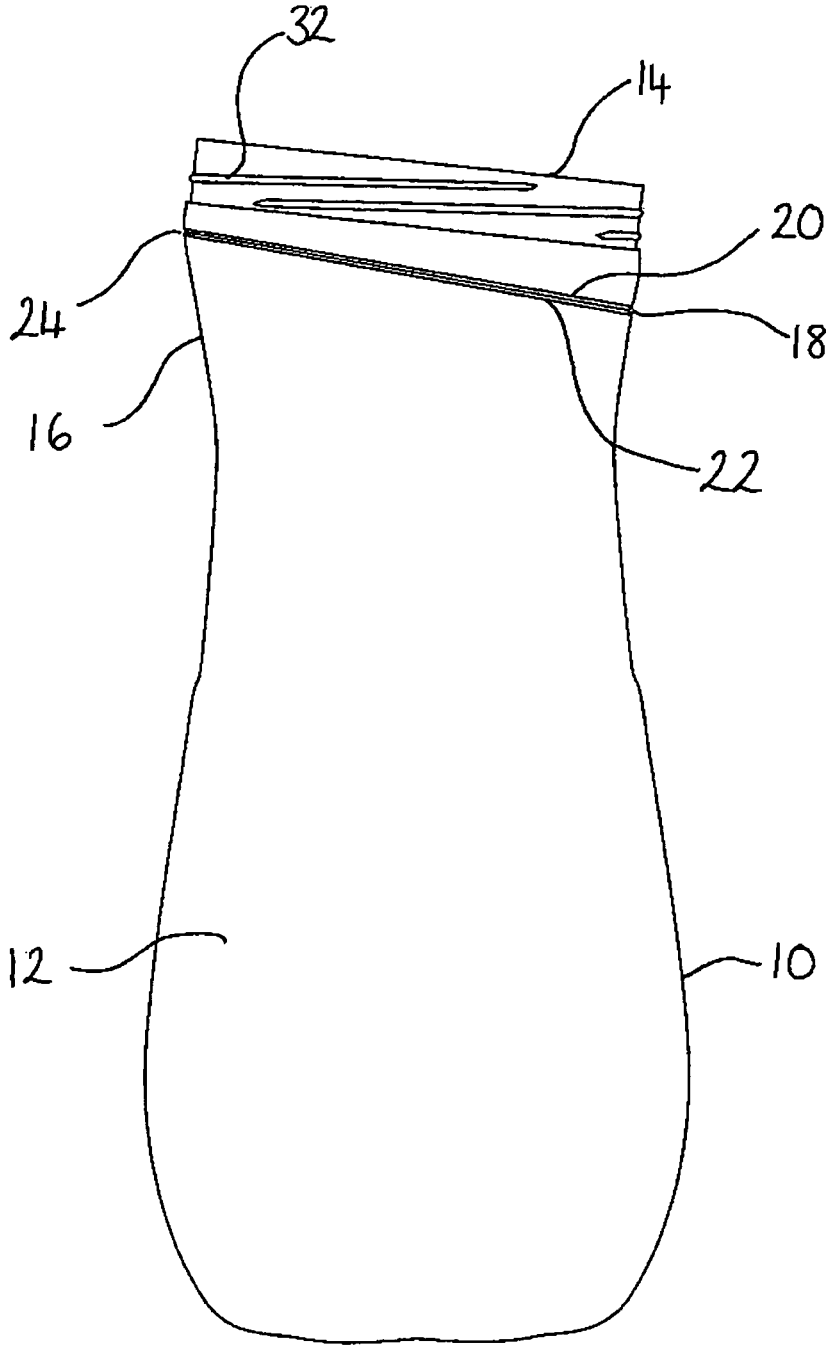
FIG. 2 is a view of the bottle from the side with the neck of the bottle in the second condition, so that the mouth is angled.
Figure 3:
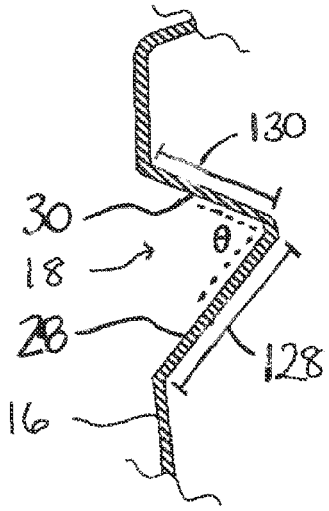
FIG. 3 is a cross-sectional view of the channel in the neck of the bottle when the neck is in the first condition.

In the following description the fluid container is a blow-moulded bottle 10 of 250 ml volume for feeding a baby. The bottle 10 is made from plastic and comprises a body 12, mouth 14, with a neck 16 in between. The neck 16 defines a channel 18. The channel 18 extends around the whole perimeter of the neck 16. The upper edge 20 and lower edge 22 of the channel 18 are both planar and are at oblique angles to the mouth 14 of the bottle 10. The upper edge 20 is at an angle of 83° to the vertical and the lower edge 22 at an angle of 71° to the vertical (the vertical axis is indicated by a dashed line in FIG. 1). The width of the channel 18 therefore increases from a hinging region 24 to maximum value at a region 26 diametrically opposite the hinging region 24. The depth of the channel 18 is also at a minimum at the hinging region 24 and at a maximum at the region 26 diametrically opposite. The channel 18 is V-shaped, and is asymmetric by virtue of a long lower sidewall 28 and a short upper sidewall 30. The short sidewall 30 is nearest the mouth 14 of the bottle 10. Preferably the long lower sidewall 28 and the short upper sidewall 30 meet in the bottom of the channel 18 at an angle θ between 50° and 90°, and more preferably at an angle of between 65° and 85°. In a preferred embodiment, the ratio of the width 128 of the long lower sidewall 28 to the width 130 of the short upper sidewall 30 at the point of greatest channel depth is between 1.25 and 1.75, and more preferably between 1.40 and 1.60.

Figure 4:
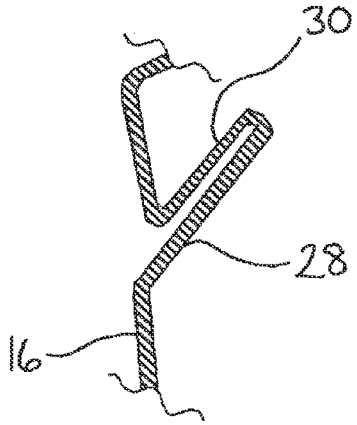
FIG. 4 is a cross-sectional view of the channel in the neck of the bottle in the second condition.
Figure 5:
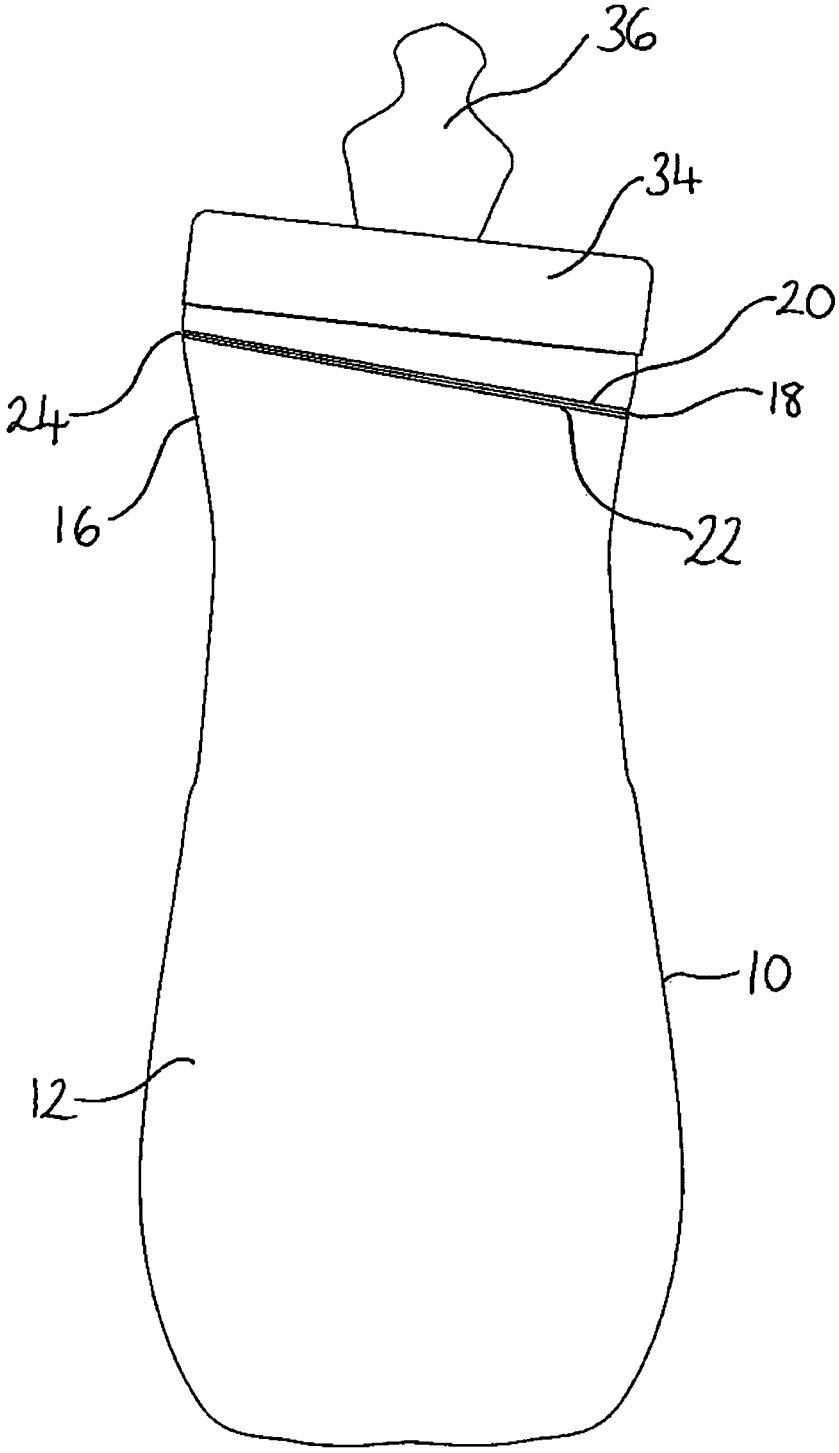
FIG. 5 is a view of the bottle from the side in the second condition, with a lid and teat fixed over the mouth of the bottle.

A screw thread 32 is provided on the mouth 14 of the bottle 10. The bottle 10 is filled with liquid and a screw cap (not shown) is applied for transport. In use, a screw ring 34 with a teat 36 is secured to the mouth 14 in place of the cap. Pressure is applied in the mouth region 14 of the bottle 10 above the region 26 at which the channel 18 is widest, causing the upper edge 20 to pivot towards the lower edge 22 about the hinge region 24. The relative angle of the mouth 14 is thus changed. Pressure is applied until a position is reached at which the sidewalls 28, 30 of the V "lock" so that the mouth is in a new stable position (see FIG. 4).

The ability of the sidewalls 28, 30 to lock will depend on a combination of factors apparent to the skilled man, and including, for example, the ratio of the depth of the channel 18 to the diameter of the neck 16. Other factors to be considered are material thickness, material properties, the depth of the channel 18, the width of the channel 18, and the diameter of the neck 16. Empirical testing will allow determination of successful combination of properties according to the intended result. The following are examples of dimensions which could be used in a PET container.

Neck 16 diameter: 45 mm
Maximum channel 18 width: 11 mm
Maximum channel 18 depth: 6 mm
Length of long sidewall 28: 6 mm
Length of short sidewall 30: 9 mm
Angle between sidewall 28 and sidewall 30: 70°

In the present embodiment, a bottle 10 for liquid baby feed is described, but a container according to the invention could be used for any pourable substance, for example a powder.

A container according to the invention could be intended to be disposable or reusable. If it is intended to be reusable, plastic would be a suitable material for the bottle, as described in the present embodiment, The skilled man would be able to select a suitable grade of plastic to use. If the container was intended for single use, other materials could also be suitable. Although a plastic container is envisaged, it is possible that other materials, such as aluminium, would also be suitable.

Although a cap with a teat for feeding is described for attachment of the bottle in the present embodiment, a lid with a spout could be used instead, to create a feeding beaker arrangement.

A handle or handles could also be provided on the body of the bottle.

In the present embodiment the body 12 of the bottle 10 is smooth, but texture could be provided, for example, ribs for grip or text or pictures for branding.

The invention has been described in relation to a bottle having a channel which is closed to provide an angled neck. Alternatively, the channel could be opened to provide an angled neck, and such a construction may be particularly useful when significant vertical loads are likely in the first stable condition.

Other variations are of course possible within the scope of the claims appended hereto.

The invention claimed is:

1. A fluid container comprising a body having a neck and further comprising a mouth, the container being deformable at the neck from a first stable condition to a second stable condition thereby to change the relative angle of the mouth, wherein:

a) in the first condition the neck defines a channel at one side which is transverse to the upright axis of the container;

b) the channel includes an upper edge and a relatively longer lower edge, and the channel is V-shaped such that ends of the upper edge meet corresponding ends of the lower edge at a hinging region;

c) the channel comprises a long sidewall that extends from the lower edge of the channel to connect to a short sidewall that extends from the upper edge of the channel, the long sidewall and the short sidewall have a width ratio from about 1.25:1 to about 1.75:1 at the point of the greatest channel depth, in the first condition of the container the upper edge is angled downward from the hinging region such that a portion of the upper edge at the point of the greatest channel depth is lower on the container and farther from the mouth relative to the ends of the upper edge, and there is no other channel above said upper edge; and d) the channel is adapted to be closed by approaching sidewalls in the second condition and to define a predetermined direction of movement from the first condition to the second condition.

2. The fluid container according to claim 1 wherein the first stable condition and the second stable condition are the only two stable conditions.

3. The fluid container according to claim 1 wherein, in the first condition, the long sidewall and the short sidewall meet at an angle θ between about 50 and about 90 degrees at the bottom of the channel.

4. The fluid container according to claim 3 wherein the angle θ is between about 65 and about 85 degrees.

5. The fluid container according to claim 1 wherein the long sidewall and the short sidewall have a width ratio from about 1.40:1 to about 1.60:1 at the point of the greatest channel depth.

6. The fluid container according to claim 1 wherein the depth of the channel increases from a minimum value at the hinging region to a maximum value at a region diametrically opposite the hinging region.

7. The fluid container according to claim 1 wherein the vertical width of the channel increases from zero at the hinging region to a maximum value at a region diametrically opposite the hinging region.

* * * * *